US005229758A

United States Patent [19]

Hsu

[11] Patent Number: 5,229,758

[45] Date of Patent: Jul. 20, 1993

[54] DISPLAY DEVICE CONTROLLER AND METHOD

[75] Inventor: Hsi-Yuan Hsu, Shindan, Taiwan

[73] Assignee: ACER Incorporated, Taiwan, Taiwan

[21] Appl. No.: 755,305

[22] Filed: Sep. 5, 1991

[51] Int. Cl.[5] ..... G09G 1/06

[52] U.S. Cl. ..... 340/723; 340/799

[58] Field of Search ..... 340/723, 750, 799, 798

[56] References Cited

U.S. PATENT DOCUMENTS

| | | | |
|---|---|---|---|
| 4,546,350 | 10/1985 | Tanaka | 340/750 |
| 4,737,780 | 4/1988 | Ishii | 340/750 |
| 4,773,026 | 9/1988 | Takahara et al. | 340/750 |
| 4,893,114 | 1/1990 | Ishii | 340/750 |
| 4,983,958 | 1/1991 | Carrick | 340/799 |

*Primary Examiner*—Alvin E. Oberley
*Assistant Examiner*—Regina Liang
*Attorney, Agent, or Firm*—Kenneth M. Kaslow

[57] ABSTRACT

A display device controller with improved read performance comprises video memory, a video display control unit, video processing logic, a write buffer and a read buffer. The write buffer and read buffer are coupled between a CPU and the video memory for transferring information between the CPU and video memory. In the preferred embodiment, the read buffer further comprises an address latch, a control circuit, a first buffer, a second buffer, a multiplexer and a counter. The control circuit stores addresses in the address latch, reads video memory, and stores the data in the first and second buffers. The control circuit determines the output to the CPU by controlling the multiplexer. The control circuit is also responsive to the counter and the read buffer is partially disabled if the miss rate is a high to reduce the negative consequences of the additional information read by the control circuit.

7 Claims, 10 Drawing Sheets

DISPLAY DEVICE CONTROLLER AND METHOD

BACKGROUND OF THE INVENTION

1. Field of the Invention

The present invention relates to display device controllers. In particular, the present invention relates to a video controller with a read buffer for reducing the time required for a central processing unit to read the memory of the video controller.

2. Description of Related Art

Many present day computer display systems often include a video controller 20 coupled between a central processing unit (CPU) 10 and a display device 16. The video controller 20 stores data representing the images to be displayed. FIG. 1 illustrates the conventional video controller 20 including a video memory 12, a video display control unit (VDCU) 14 and a video processing device 18. The CPU 10 transmits data and control signals to video memory 12 and refreshes the information stored in video memory 12. Aside from other control functions, the VDCU 14 periodically causes the video memory 12 to send data to the video processing device 18. The video processing device 18 then strings the data in a line and transmits it to display device 16. Using this method, the information on display device 16 is periodically refreshed.

As shown in FIG. 1, a typical video system allows either CPU 10 or VDCU 14 to utilize memory 12 at any particular instant. Therefore, it is necessary to allocate times for CPU 10 and VDCU 14 to utilize memory 12. Otherwise, both devices 10, 14 may attempt to use memory 12 simultaneously which causes unpredictable results. The typical method for allocating time periods to access memory 12 usually divides the CPU cycle into time frames for each device 10, 14 to use memory 12. Under such an allocation scheme, CPU 10 can only utilize memory 12 between t1 and t3, and between t5 and t6, as shown in FIG. 2. The periods between t3 and t5 and between t6 and t7 are allocated for use of memory 12 by VDCU 14. However, the prior art CPU cycle allocation method causes system delays. As shown in FIG. 2, no delay is caused by the allocation scheme as long as the memory write (MEMW) signal is pulled low near the beginning of time frame allocated for use by CPU 10 as shown in waveform B. If the memory write (MEMW) signal is pulled low after more than half the allocated time frame has elapsed (e.g., between t2 to t3), then CPU 10 must wait until the next CPU slot for access to memory 12, as shown in waveforms C and D. Having to wait for the next available CPU slot causes considerable delay in processing.

The prior art has added a write buffer 22 to reduce the effects of the aforementioned system processing delay. For example, U.S. patent application Ser. No. 07/602,479 discloses a video controller with write buffer 22 to store the control and data signals sent by CPU 10, and send these signals to video memory 12 during the next time slot allocated to CPU 10. Write buffer 22 greatly improves the efficiency of writing to video memory 12 as well as the efficiency of the entire computer system.

However, write buffer 22 does not improve the efficiency of reading the video memory 12. To improve the efficiency of CPU 10 reading data from video memory 12, the prior art includes a cache memory and controller 24. As shown in FIG. 3, cache memory and controller 24 is located in controller 20, and coupled between CPU 10 and video memory 12. Cache memory 24 is used to store blocks that have been retrieved from video memory 12. Cache memory 24 reads the data from video memory 12 during the cycle time allocated to CPU 10. However, once the data has been stored in cache memory 24, CPU 10 may read the data from cache memory 24 at any time, even during the time slot allocated for VDCU 14 to access video memory 12.

If CPU 10 attempts to read the data at a particular address in video memory 12, the data must be transferred to cache memory 24 unless the data is already stored in cache memory 24. If the data of the particular address is not in cache memory 24 (a "miss"), cache controller 24 reads the data at the particular address and the data at several successive addresses, and stores this block of data in cache memory 24. If the desired data is stored in cache memory 24 (a "hit"), the data can be sent from cache memory 24 to CPU 10 even though CPU 10 is in a cycle time allotted to the VDCU 14. Therefore, the efficiency of CPU 10 in reading video memory 12 is improved with the addition of cache memory and controller 24.

FIG. 4 illustrates a timing diagram for a video system using cache memory 24 shown in FIG. 3. The timing diagram shows two memory read cycles initiated by CPU 10. The first cycle illustrates a "miss," and the second cycle illustrates a "hit." When the MISS signal is high, it indicates that the data to be read is not in cache memory 24, and when the MISS signal is low it indicates that the data to be read is stored in cache memory 24. A READY signal tells CPU 10 when the data can be read from cache 24. Only when the READY signal is high can CPU 10 complete the memory read cycle by pulling the MEMORY READ signal high. The Row Address Strobe (RAS) and Column Address Strobe (CAS) signals are both output signals of controller 20, and are used to read the data in video memory 12 as will be understood by those skilled in the art. As shown in FIG. 4, CPU 10 reads DATA 1 directly from video memory 12 during the time period allocated to CPU 10, whereas DATA 2 is read from cache memory 24 outside of the allocated time period and in a much shorter time.

One problem with cache memory 24 is that if the occurrences of a "miss" are frequent, then the use of cache memory 24 becomes inefficient. The inefficiency results because not only the data of the particular address of interest, but also the data at several successive addresses must also be read from video memory 12 and stored in cache memory 24. The process of reading in extra data not only wastes time, but also occupies space in the cache static memory that may be used for other operations. Another problem with cache memory 24 is the hardware cost. The cache memory 24 comprises several groups of Static Random Access Memory (SRAM) together with cache control device that can be relatively expensive. Furthermore, the extra data read and stored by cache memory 24 is often unused in the standard process for generating images on display device 16.

Therefore, there is a need for a system and method for improving the efficiency in reading video memory without the hardware costs and the shortcomings of the prior art.

SUMMARY OF THE INVENTION

The present invention overcomes the deficiencies of the prior art by providing a display device controller with improved read performance. A preferred embodiment of the display device controller of the present invention comprises video memory, a video display control unit, video processing logic, a write buffer and a read buffer. The write buffer and read buffer are coupled between the CPU and the video memory. Data is transferred to the video memory using the write buffer. Data is transferred from the video memory to the CPU through the read buffer. The read buffer is used to temporarily store data from video memory for use by the CPU.

In the preferred embodiment, the read buffer further comprises an address latch, a control circuit, a first buffer, a second buffer, a multiplexer and a counter. The control circuit stores addresses in the address latch, reads video memory, and stores the read data in the first and second buffers. The control circuit determines the output to the CPU by controlling the multiplexer. The control circuit is also responsive to the counter and the read buffer is partially disabled if the miss rate is a high to reduce the negative consequences of the additional information being read by the control circuit.

DETAILED DESCRIPTION OF THE PREFERRED EMBODIMENT

Figure 5:
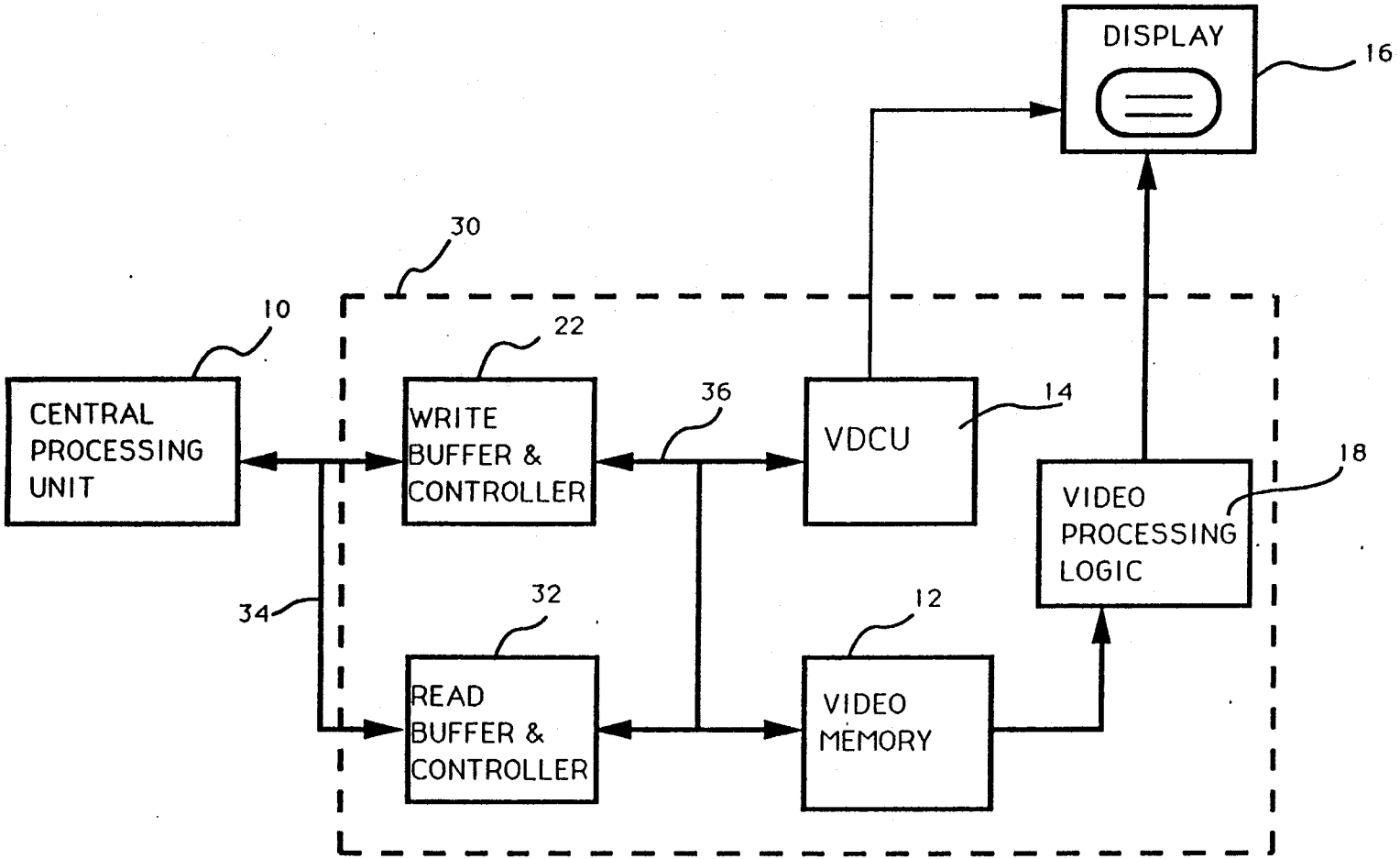
FIG. 5 is a block diagram of a preferred embodiment for the display device controller of the present invention.

In many of the graphics software being sold in the marketplace, all the addresses of video memory 12 are generally read successively when the software program is executed. The present invention improves the efficiency of video controllers by including a read buffer 32 for temporarily storing data read from video memory 12 for use by CPU 10. Referring now to FIG. 5, a functional block diagram of a preferred embodiment of the present invention is shown. For ease of understanding like reference numbers are used to identify like parts. In the preferred embodiment, a video controller 30 comprises video memory 12, a video display control unit 14, video processing logic 18, a write buffer 22 and a read buffer 32. Video controller 30 is preferably coupled between CPU 10 and display device 16. Controller 30 is coupled to CPU 10 by a bus 34 that carries data, addresses and control signals. Bus 34 is preferably coupled between CPU 10, write buffer 22 and read buffer 32. Video controller 30 is also coupled to display device 16 by coupling VDCU 14 and video processing logic 18 to display device 16 for sending control and data signals, respectively.

The video memory 12, VDCU 14, video processing logic 18 and write buffer 22 are preferably conventional types of devices known to those skilled in the art. The video memory 12, VDCU 14, write buffer 22 and read buffer 24 are coupled by a bus 36 for sending data, addresses and control signals between these devices. Video memory 12 is also coupled to send data to video processing logic 18 in response to control signals from the VDCU 14.

Figure 6A:
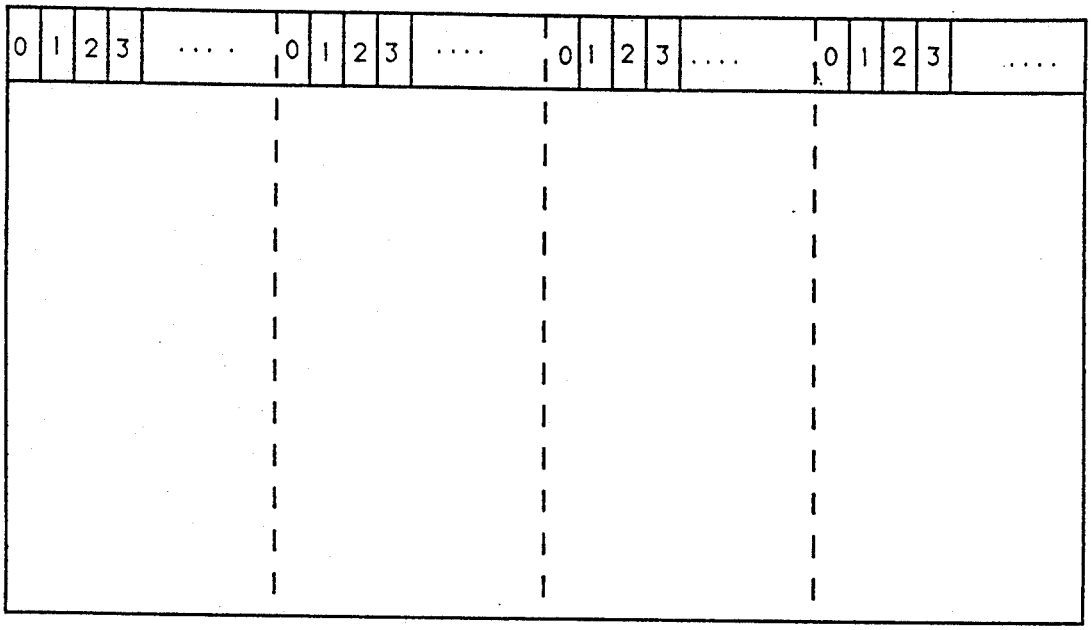
Figure 6A (Prior Art)
FIGS. 6A and 6B are diagrams of address mapping schemes for the video memory of the present invention.
Figure 6B:
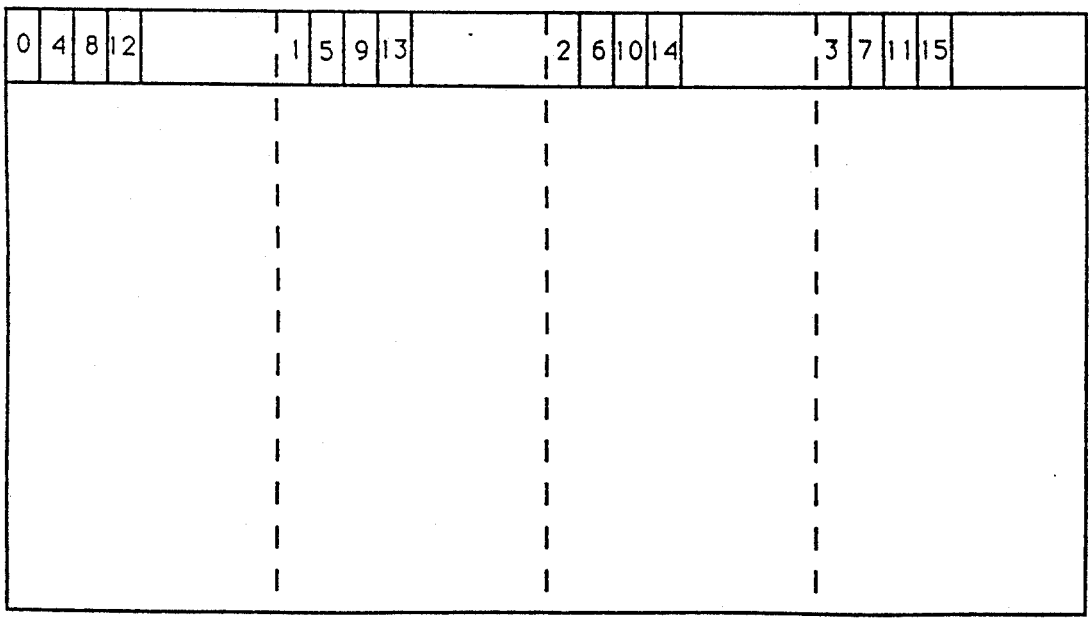
Figure 6B (Prior Art)

The Video Graphics Array (VGA) standard principally offers two types of modes for mapping memory. One type is called the packed pixel mode, the other is called the bit-mapped mode. FIG. 6 show the conditions of video memory 12 mapping to CPU 10 address space under each mode. In the packed-pixel mode, the bit information of a pixel is entirely located on a single bit plane, whereas, in the bit-mapping mode, the bit data of a pixel is located on several bit planes. The standard VGA video card typically has four bit planes numbered 0, 1, 2 and 3. A detailed explanation of the packed pixel mode and the bit-mapped mode can be found in reference materials concerning VGA's, such as Richard F. Ferraros' *Programmer's Guide to EGA and VGA Cards* from Addison-Wesley Publishing Company, published in 1988. Under Video Graphics Array (VGA) standards, every time CPU 10 initiates a memory read cycle, 32 bits of data are read from video memory 12 to the VGA. In the bit-mapping mode, these four bytes of data of different bit planes correspond to a single CPU address. However, in a packed pixel mode, this same four bytes of data corresponds to four different CPU addresses. This can be seen from (a) and (b) of FIG. 6. These four bytes of data, both in packed-pixel or bit-mapped mode, have the same memory address.

In the packed-pixel mode, every time CPU 10 begins a read operation, aside from being able to obtain the data from the access address, a first buffer 94 in video controller 30 (FIG. 7) also stores the data of the other three locations which have the same memory address. Thus, the next time CPU 10 initiates a video memory read operation, the data is within the first buffer 94, so that CPU 10 can directly read the data in first buffer 94, and CPU 10 does not have to read the data from video memory 12. Therefore, the present invention advantageously improves the speed at which CPU 10 reads video memory 12 nearly by a factor of four. In other words, video memory 12 sends 32 bits of data to first buffer 94 at one time which can supply CPU 10 with data for four successive read operations if the first read operation is addressed on bit plane number 0.

Figure 7:
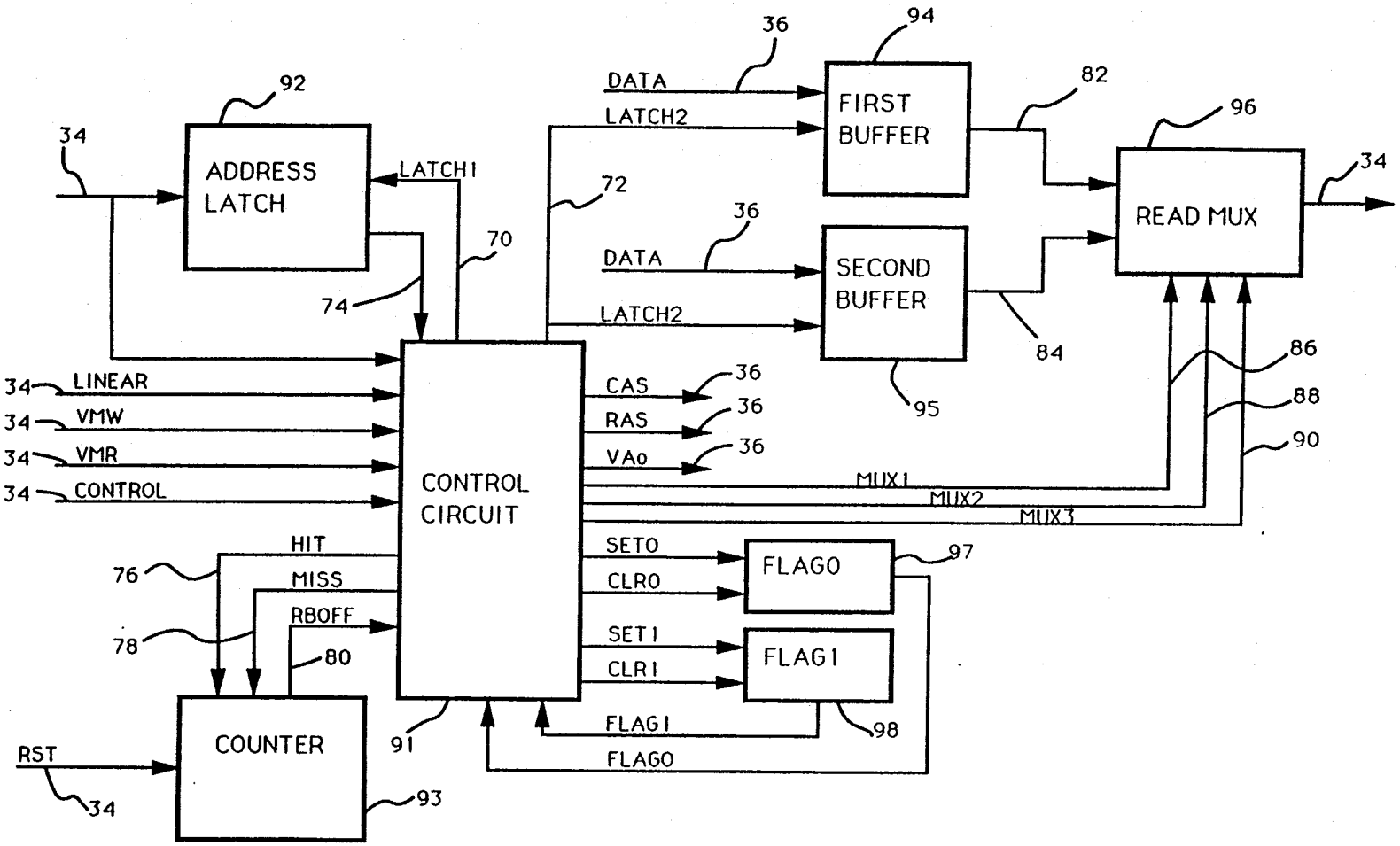
FIG. 7 is a schematic diagram of the preferred embodiment of the read buffer of the present invention.

FIG. 7 shows a schematic diagram of a preferred embodiment of read buffer 32. Read buffer 32 preferably comprises a control circuit 91, an address latch 92, a counter 93, a first buffer 94, a second buffer 95, a read multiplexer 96, a first flag register 97 and a second flag register 98. Address latch 92 is coupled to bus 34 to receive addresses from CPU 10 corresponding to data in video memory 12. Address latch 92 also receives a LATCH1 signal on line 70 from control circuit 97. The LATCH1 signal 70 controls the storage of the address input from bus 34 into address latch 92. Address latch 92 outputs the stored address on line 74 that is coupled to control circuit 91. For purposes of illustration, assume that controller 30, is located in the AOOOO-BFFFF (Hex) range of the CPU address space.

Control circuit 91 operates read buffer 32 and is responsive to control signals from CPU 10 on bus 34. For example, control circuit 91 is preferably coupled to receive the control signals LINEAR, VIDEO MEMORY WRITE (VMW), VIDEO MEMORY READ (VMR) and CONTROL from bus 34. The control circuit 91 can identify the type of operation, read or write, currently being executed by CPU 10 using the VMR and VMW signals. Control circuit 91 is also coupled to bus 36 to send and receive signals from video memory 12, VDCU 14 and write buffer 22. Control circuit 91 preferably sends the control signals CAS, RAS and VAo on bus 36. Control circuit 91 also generates the LATCH2 signal on line 72 that controls the latching of data in first buffer 94 and second buffer 95.

In the following description, we assume the first read operation of a series of read operations is addressed on bit plane 0 for ease of understanding. The operation of read buffer 32 will now be described using the packed-pixel mode. The LINEAR signal indicates the present addressing mode to control circuit 91. Control circuit 91 executes a judgment motion by deciding whether or not the present read memory address (not CPU address) is the same as the memory address of the CPU 10 on the signal line 74. If it is not, control circuit 91 outputs the LATCH1 signal 70 to address latch 92, which causes latch 92 to store the address at its input. The address signal on line 74 is output and sent by address latch 92 to control circuit 91. Control circuit 91 also receives an address signal on bus 34 sent from CPU 10. When the difference between the connected addresses of the current read operation on bus 34 and the address stored in the latch 92 as indicated by address signal 74 is within a range of four addresses, LATCH1 signal 70 does not change and address latch 92 does not store the address signal presently on bus 34. Similarly, when the difference between the address on bus 34 and the address output by address latch 92 on address signal 74 is outside the range of four addresses, then LATCH1 signal 70 is asserted, the address on bus 34 is stored in address latch 92, and the address is output on line 74.

For example, suppose address signal 74 has a value of A0000 (hex), and the video memory address to be read on bus 34 is A0003 (hex). Thus, A0003 falls within the four address range of A0000. The last time buffer 32 read the indicated address A0000 (hex), it read the 32 bits of data of the four addresses A0000, A0001, A0002 and A0003 from video memory 12 via bus 36. Because of the address mapping shown in FIG. 6, the data for the four addresses is stored in buffer 94 by control of the four latch control lines (Latch 2) 72. Therefore, the data to be read can be directly accessed from buffer 94. At this time, LATCH1 signal remains unchanged, and it is not necessary to latch address A0003 (hex).

On the other hand, if the address to be read is A0004 (hex) and the address on signal line 74 was A0000 (hex), the data corresponding to the address to be read (A0004) is not stored in buffer 94 because the address falls outside the four address range. Thus, video memory 12 must be accessed to retrieve the data of interest. Once the next CPU time slot occurs, controller 30 transfers the 32 bits of data of all four addresses A0004, A0005, A0006, A0007 (hex) via bus 36 to buffer 94. At the same time, control circuit 91 forces LATCH1 signal 70 to transition, and address latch 92 stores and outputs address A0004 as address signal 74.

If the above described address signals 34, 74, are within the range of four addresses a "hit" has occurred, and control circuit 91 sends the HIT signal on line 76 to counter 93. If the difference between the address signals 34, 74*c* is greater that the range of four addresses, a "miss" has occurred, and control circuit 91 sends a MISS signal on line 78 to counter 93. When there is a hit, controller 30 transfers the data of the indicated address directly from buffer 94 via a signal line 82 and multiplexer 96 to data bus 34. When there is a miss, controller 30 accesses the data of interest and the data corresponding to the next three successive addresses from video memory 12, and provides the data of interest on bus 34 as output by buffer 94.

The read buffer 32 also includes first and second flag registers 97, 98. Flag register 97 stores the flag value output (FLAG0) and has two inputs coupled to control unit 91 to receive the SET0 and CLR0 signals. Flag register 97 is coupled to an input of control circuit 91 to provide the FLAG0 signal output by flag register 97. Similarly, flag register 98 is coupled to receive the SET1 and CLR1 signals from control unit 91. Flag register 98 is also coupled to control unit 91 to send the FLAG1 signal to control circuit 91. The FLAG0 and FLAG1 signals are used to indicate whether the data stored in buffer 94 and 95 are valid.

When video memory 12 is read and a miss occurs, 32 bits of data will be retrieved from video memory 12 and stored in buffer 94. At the same time, control circuit 91 asserts SET0 signal to set FLAG0 at 1, indicating that the data currently in buffer 94 and in video memory 12 should be the same data. This is called effective data. Any write operations that are performed after the data is stored in buffer 94 may affect the validity of the data in buffer 94 since the write operation may have changed the data in video memory 12, and the data in buffer 94 does not include any changes to the data made in the last write operation. Therefore, control circuit 91 also determines whether the address on bus 34 is hit or a miss during the memory write period. If a hit occurs, then the data stored in the buffer 94 no longer reflects the updated data of the corresponding address in video memory 12. Once the hit is detected, control circuit 91 asserts the CLR0 signal, and value of the FLAG0 signal is set to 0, indicating the data in buffer 94 is not valid and cannot be used. Naturally, if the write operation is a miss, the clear CLR0 signal is not asserted, and the data in buffer 94 is still valid and usable. If a memory read operation occurs when the data in buffer 94 is not valid, control circuit 91 must access video memory 12 to retrieve the updated data and store it in buffer 94.

Control circuit 91 also outputs multiplexer control signals (MUX1, MUX2 and MUX 3) on lines 86, 88 and 90 to multiplexer 96. These multiplexer signals are used to select the desired byte of data to output on data bus 34 from the four bytes of data output by first buffer 94 on line 82 and the four bytes of data output by second buffer 95 on line 84. The multiplexer 94 is preferably a conventional type such as a plurality of 8-to-1 multiplexers, or groups of 4-to-1 multiplexers and 2-to-1 multiplexers.

Figure 1:
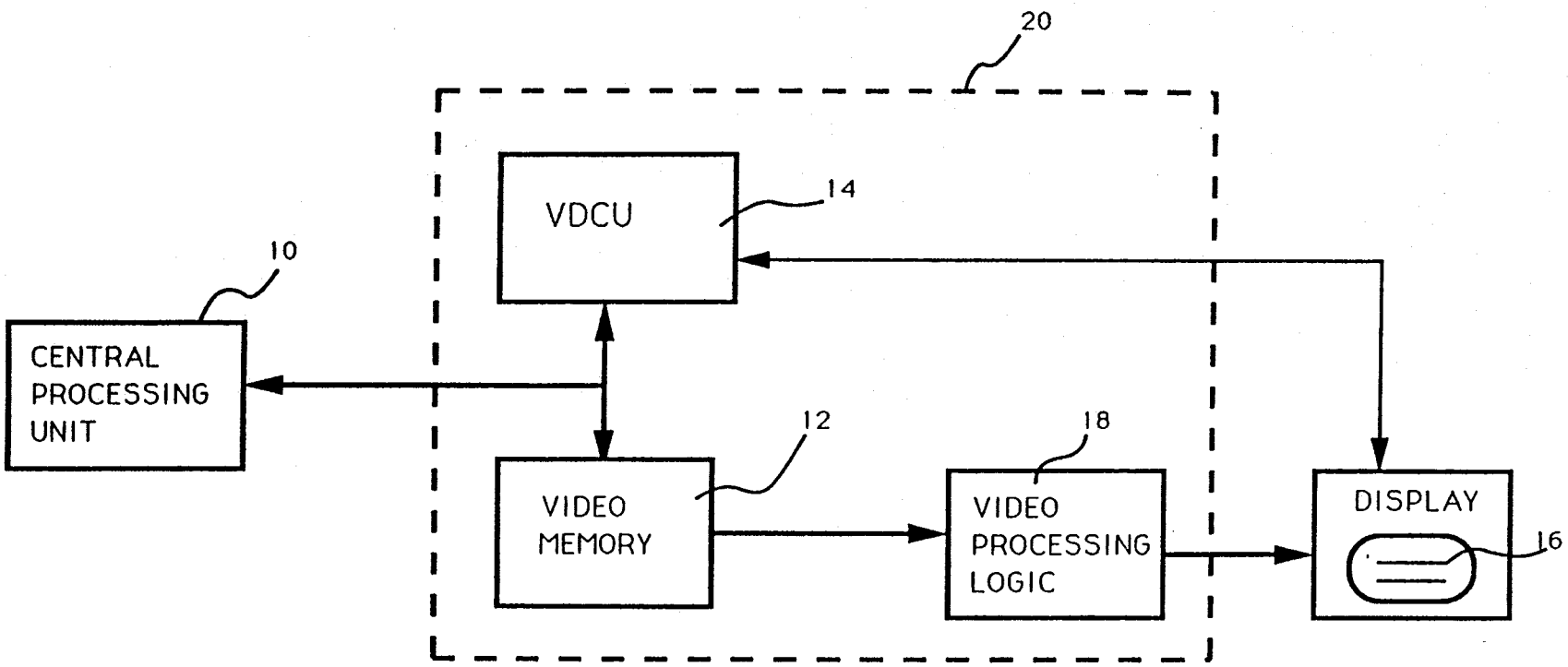
Figure 1 (Prior Art)
FIG. 1 is a block diagram of a prior art video system.
Figure 2:
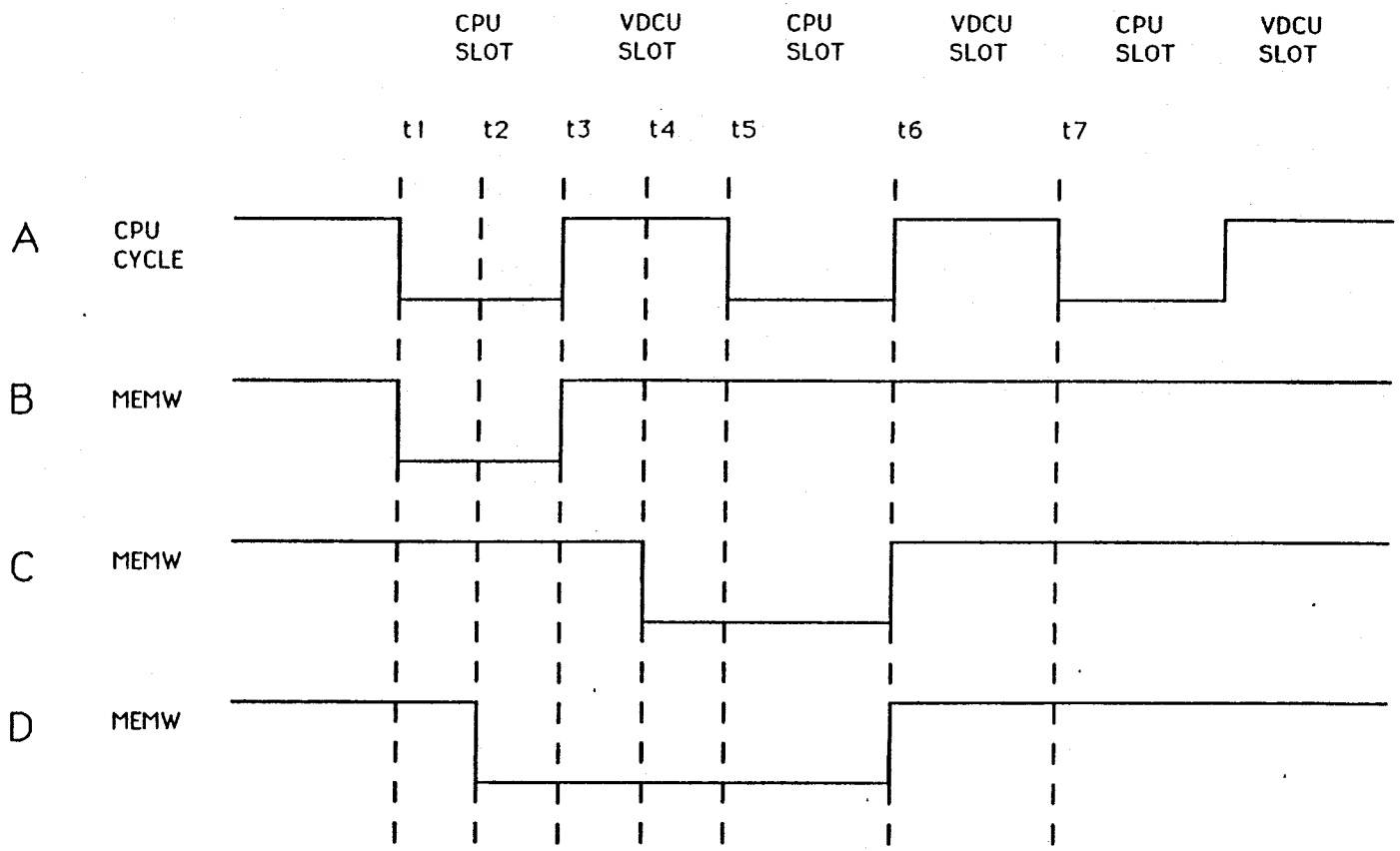
Figure 2 (Prior Art)
FIGS. 2 is a timing diagram for the prior art video system of FIG. 1.
Figure 3:
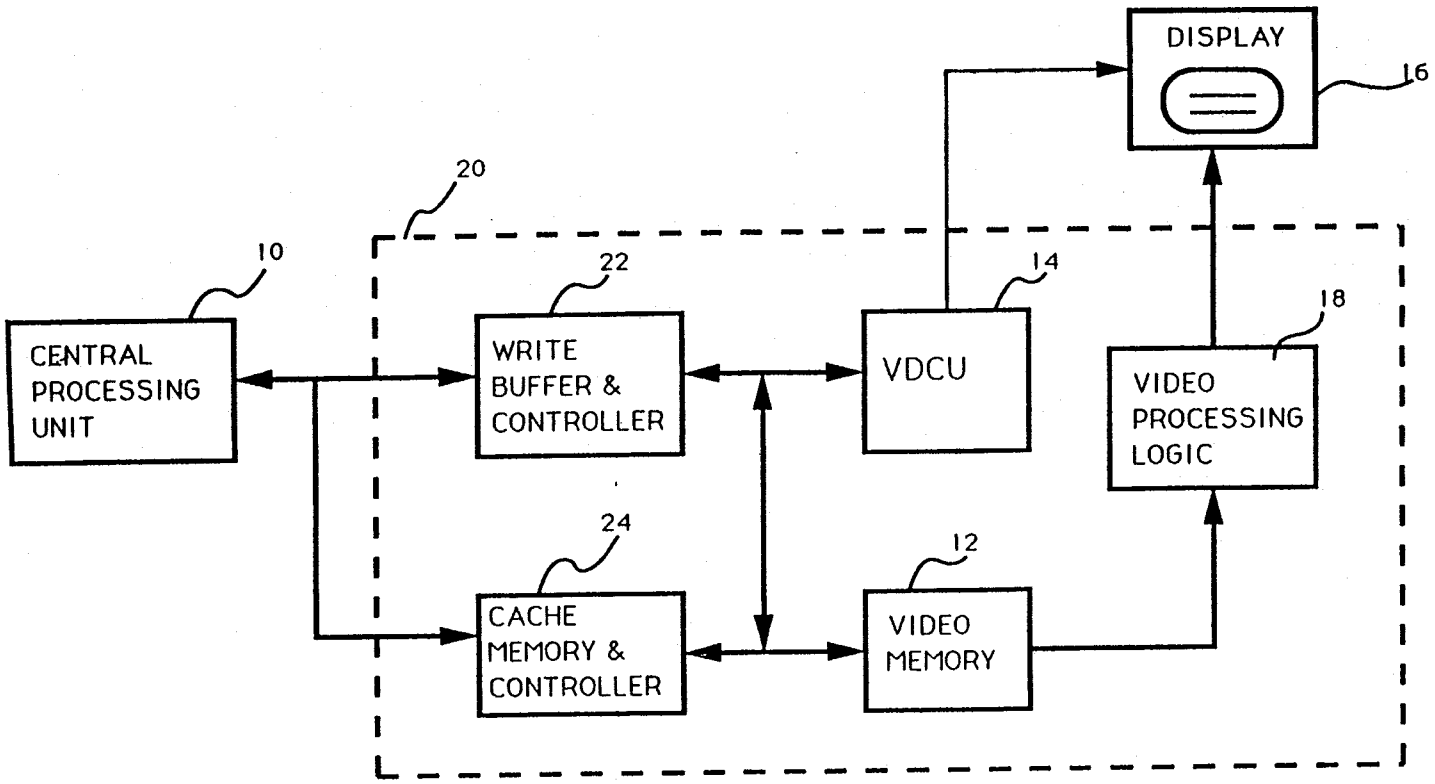
Figure 3 (Prior Art)
FIG. 3 is a block diagram of a prior art video system with cache memory.
Figure 4:
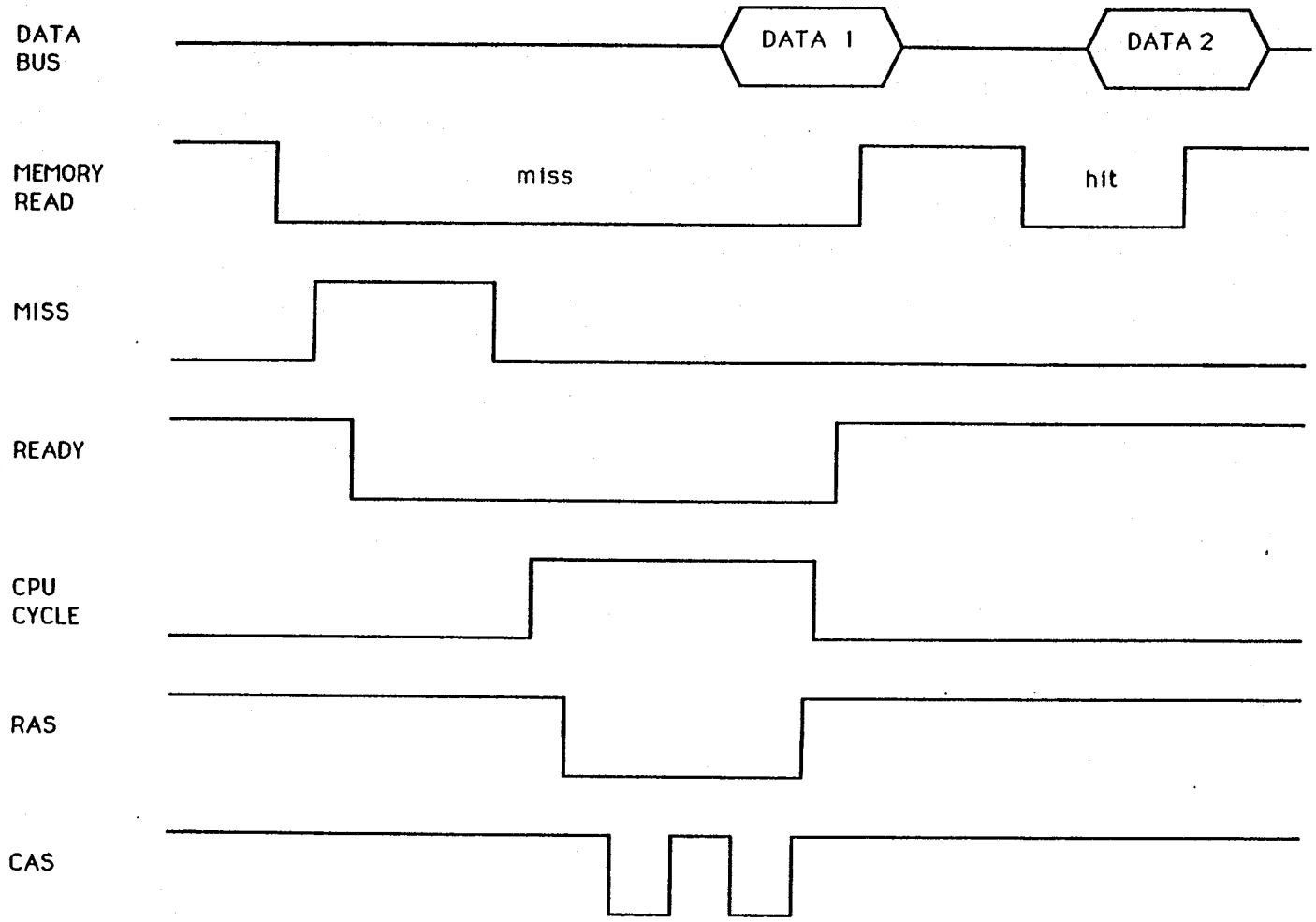
FIG. 4 is a timing diagram for the prior art video system of FIG. 3.
Figure 8:
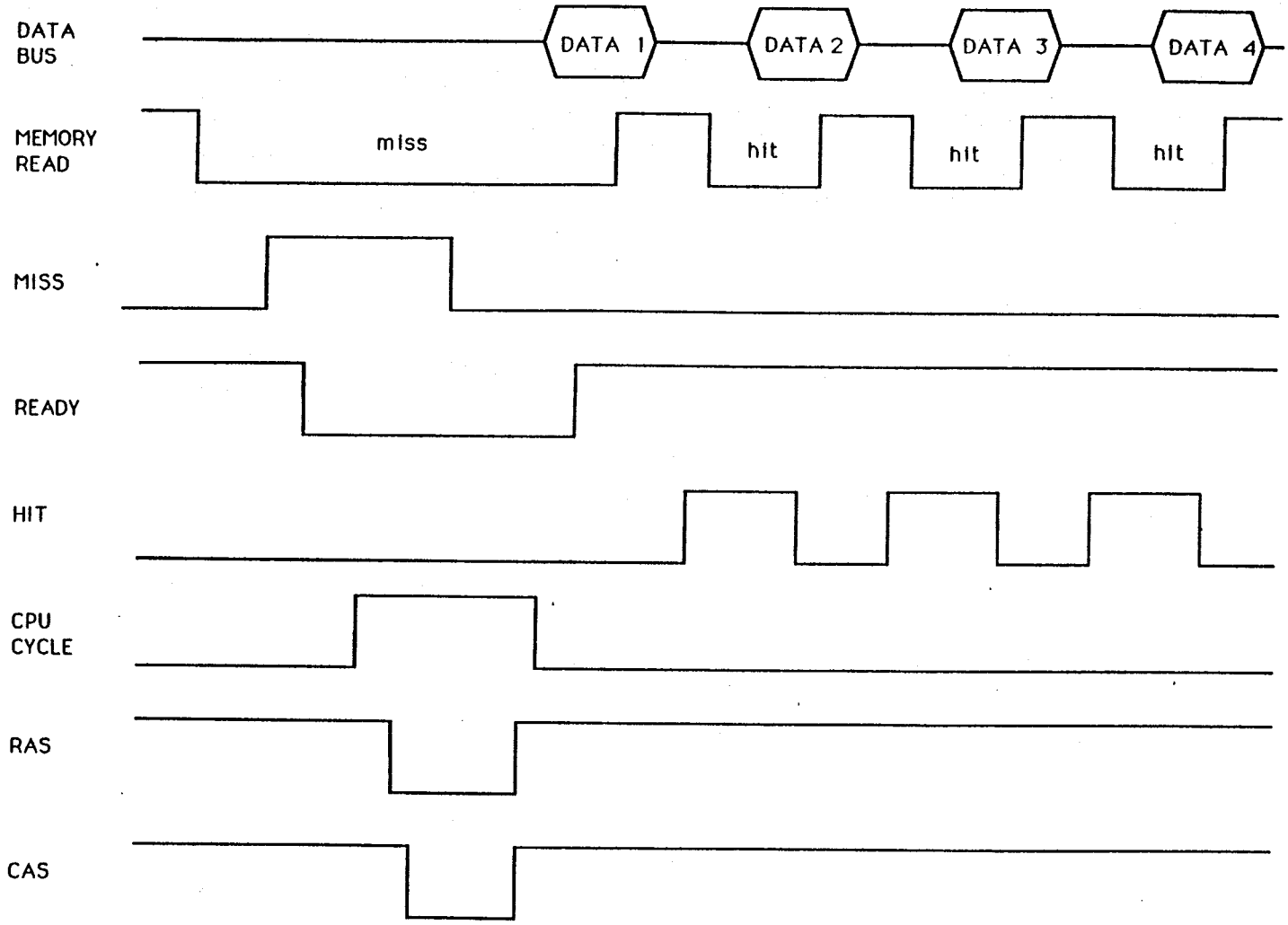
FIG. 8 is a timing diagram for packed-pixel mode operation of the preferred embodiment of the present invention.

After the system in which controller 30 operates is reset, the RST signal is output by CPU 10 to counter 93. Counter 93 is reset to zero by the RST signal. Counter 93 receives the hit and miss signals on lines 76 an 78, respectively, from control circuit 91. Counter 93 outputs a RBOFF signal on line 80 to control circuit 91. Every time the hit signal 76 is asserted the count value is increased by one, and every time a miss signal 78 is asserted the count value is decreased by one. However, after decreasing to any preset value (for example −2), counter 93 does not decrease further. If the count value has been below zero value for a prescribed amount of time, this indicates that the hit rate is too low, and that the addresses CPU 10 is currently reading are not successive. Counter 93 asserts the RBOFF signal 80 that automatically turns off most of the functions of control circuit 91. However, control circuit 91 continues to monitor the hit rate. If after a period of time the count value again returns to a value above the zero value, the hit rate has increased, and the RBOFF signal is removed to return the read buffer 32 to be fully operational. If the first read is a miss, and the 3 successive reads are all hits, the timing diagram of the present invention in the packed pixel mode is shown in FIG. 8. The signals illustrated in FIG. 8 are similar to those described in FIG. 4.

Referring now to the bit-mapped mode, a preferred embodiment of the present invention offers at least first and second buffers 94, 95 to store data. As shown in FIG. 7, besides first buffer 94, a second buffer 95 may also be included. Buffer 95 receives data from bus 36 and latch control signal (Latch 2) on line 72 from control unit 91. 361. The data stored in second buffer 95 is output on line 84 to multiplexer 96 for output on bus 34.

Figure 9:
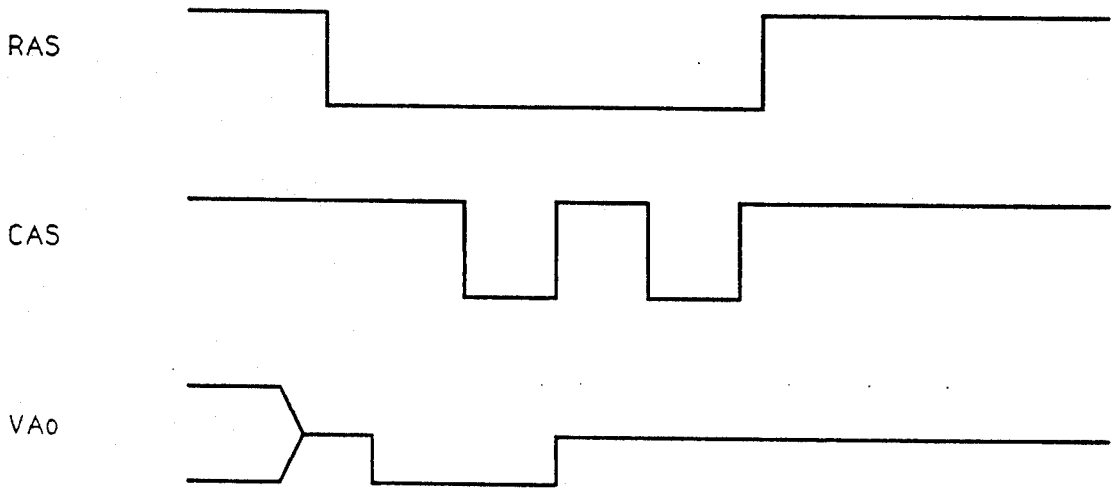
FIG. 9 is a timing diagram of the control signals produced by the read buffer of the present invention.

If the LINEAR signal is asserted, then control circuit 91 operates in a bit-mapped mode. Assuming the memory address is A0000(hex) and a miss has occurred, control circuit 91 sends the data of address A0000 (hex) from bus 36 through buffer 94 and multiplexer 96 to data bus 34, and also reads the data of address A0001 (hex) and stores it in buffer 95. Control circuit 91 can read video memory 12 using control signals RAS, CAS, VAo which are output by control circuit 91 to video memory 12. The VAo signal 36 is the least significant bit of the address signal. For example, when address A0000 is read, VAo is zero. After the data at address A0000 is read into buffer 94, control circuit 91 changes the VAo signal to 1. Therefore, the value of the address line becomes A0001. Next, the CAS signal is pulled low and the A0001 address value enters video memory 12. The data then proceeds to bus 36, and the LATCH2 signal 72 is asserted to store the data on bus 36 in buffer 95. The operation of the control signals is best illustrated by the timing diagram of FIG. 9.

If the address for the next read operation is A0001 (hex), control circuit 91 determines that a hit has occurred and control circuit 91 sends the data in buffer 95 to bus 34 by asserting the multiplexer control signal (MUX 3). Naturally, if the next read operation is still A0000 (hex), control circuit 91 still outputs the data on line 82 to data bus 34. The MUX1 and MUX2 signals 86 and 88 are also used to choose one byte from four bytes to send to the data bus 34 in the bit-mapped mode. As with buffer 94, the operation of buffer 95 uses second flag register 98, which receives the SET1 and CLR1 signals 954 as its two input signals, and outputs a FLAG1 signal. The operation of second flag register 98 is preferably the same as that of first flag register 97. In FIG. 7, the present invention only provides a single buffer 95, however, those skilled in the art will realize that several buffers may be used for bit-mapping modes, with only nominal increases in the hardware costs.

Figure 10:
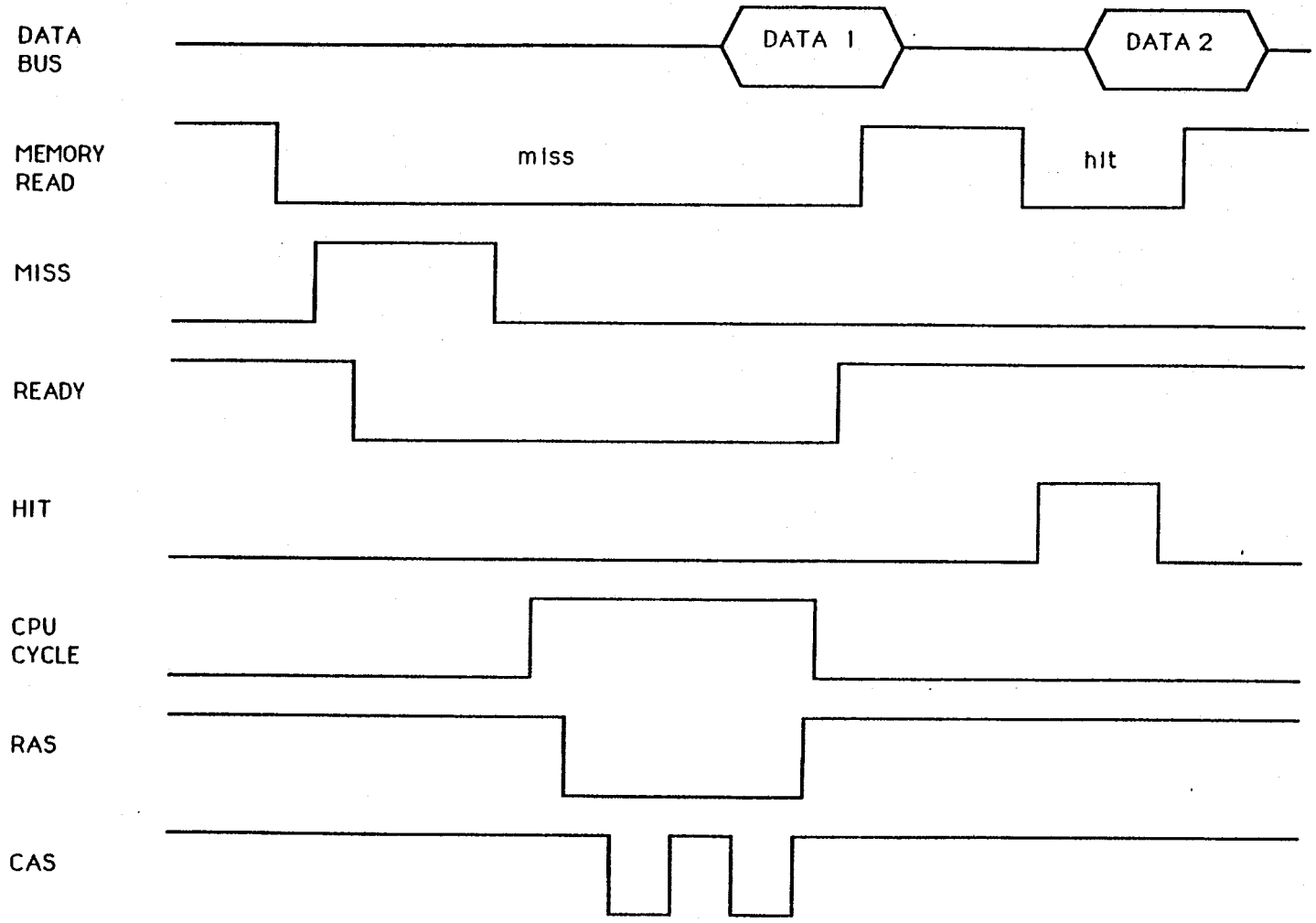
FIG. 10 is a timing diagram of for bit-mapping mode operation of the preferred embodiment of the present invention.

Referring now to FIG. 10, a timing diagram for the bit-mapped mode operation showing the signals where the first read is a miss, and the next read is a hit. Since second buffer 95 is used in the bit-mapping mode, if a hit occurs, such data can be directly accessed from second buffer 95, and it is not necessary to retrieve the data from video memory 12. Thus, the efficiency is improved about two-fold. In the preferred embodiment, counter 93 advantageously reduces the negative consequences suffered by cache memory 24 by turning off read buffer 32 whenever the rate of miss conditions is high.

Thus, the present invention provides an device that improves the read performance for both the packed-pixel mode and the bit-mapped mode. The present invention also greatly reduces the negative consequences by disabling the read buffer operation when the miss rate is high.

It should be understood that the functional blocks of FIG. 5 are provided by way of example. Equivalent modifications or rearrangement is possible for those skilled in the art. For example, the control function of write buffer 32 and VDCU 14 may be easily combined into a single control block in an alternate embodiment.

What is claimed is:

1. An apparatus in a computer system for controlling a display device, the computer system having video memory that is divided into N bit planes and a processing unit that is coupled to the apparatus, the apparatus outputting a memory address for the N bit planes in response to a processor address output by the processing unit for reading the video memory, the apparatus fetching N bytes of data in response to the processor address, one of N bytes of data from one location in the N bit planes corresponding to the processor address and a remaining N−1 bytes of data from locations having the same memory address on the remaining N−1 bit planes, the apparatus operated under a first mode or a second mode in response to a mode selection signal, the N bytes of data mapped into N different processor addresses under the first mode and the same N bytes of data mapped into one single processor address under the second mode, said apparatus comprising:

a data buffer having an input and an output for storing bytes of data from video memory, the input of the data buffer coupled to the video memory, and the output of the data buffer coupled to the processing unit; and a control means having an input and an output for determining whether the data stored in the data buffer are the same as the data stored in the video memory for an address signal sent to the apparatus and selectively outputting the data corresponding to the address signal from the video memory and from the data buffer in response to signals from the processing unit and the mode selection signal, the input of the control means coupled to the processing unit and the output of the control means coupled to the video memory.

2. The apparatus of claim 1, wherein N is equal to four.

3. The apparatus of claim 1, wherein the control means comprises a flag register indicating whether the data stored in the data buffer are the same as the data stored in the corresponding address of the video memory.

4. The apparatus of claim 1, further comprising a multiplexer having inputs coupled to the output of the data buffer, and having outputs coupled to the processing unit, said multiplexer selectively outputting data from the data buffer to the processing unit in response to a control signal from the control means.

5. The apparatus of claim 1, further comprising a disabling means having inputs coupled to the control means for receiving a hit signal and a miss signal, and an output coupled to the control means for sending a disabling signal.

6. The apparatus of claim 5, wherein the disabling means is a counter.

7. The apparatus of claim 1, wherein the first mode is a packed-pixel mode and the second mode is a bit-mapped mode.

* * * * *